US007219065B1

(12) United States Patent
Vandali et al.

(10) Patent No.: US 7,219,065 B1
(45) Date of Patent: May 15, 2007

(54) EMPHASIS OF SHORT-DURATION TRANSIENT SPEECH FEATURES

(76) Inventors: Andrew E. Vandali, 14 Arncliffe Boulevard, Greenvale, Victoria 3059 (AU); Graeme M. Clark, 13 Banoon Road, Eltham, Victoria 3095 (AU)

( * ) Notice: Subject to any disclaimer, the term of this patent is extended or adjusted under 35 U.S.C. 154(b) by 720 days.

(21) Appl. No.: 10/088,334

(22) PCT Filed: Oct. 25, 2000

(86) PCT No.: PCT/AU00/01310

§ 371 (c)(1),
(2), (4) Date: Jul. 15, 2002

(87) PCT Pub. No.: WO01/31632

PCT Pub. Date: May 3, 2001

(30) Foreign Application Priority Data

Oct. 26, 1999 (AU) ..... PQ3667

(51) Int. Cl.
*G10L 21/02* (2006.01)

(52) U.S. Cl. ..... 704/278; 704/200.1; 704/214; 704/254; 704/267; 704/225

(58) Field of Classification Search ..... None
See application file for complete search history.

(56) References Cited

U.S. PATENT DOCUMENTS 4,051,331 A 9/1977 Strong et al.
4,061,875 A 12/1977 Freifeld et al.
4,191,864 A 3/1980 Sopher
4,249,042 A 2/1981 Orban
4,357,497 A 11/1982 Hochmair
4,390,756 A 6/1983 Hoffman et al.
4,441,202 A 4/1984 Tong et al.
4,454,609 A 6/1984 Kates
4,515,158 A 5/1985 Patrick et al.
4,536,844 A 8/1985 Lyon
4,593,696 A 6/1986 Hochmair et al.
4,661,981 A 4/1987 Henrickson et al.
4,696,039 A * 9/1987 Doddington ..... 704/215
4,887,299 A 12/1989 Cummins et al.

(Continued)

FOREIGN PATENT DOCUMENTS

AU 17065/92 A 7/1991

(Continued)

OTHER PUBLICATIONS

Glenn D. White, "The Audio Dictionary," University of Washington Press, Seattle, WA (1987), pp. 202-203.*

(Continued)

*Primary Examiner*—Donald L. Storm
(74) *Attorney, Agent, or Firm*—Jagtiani + Guttag

(57) ABSTRACT

A sound processor including a microphone (1), a pre-amplifier (2), a bank of N parallel filters (3), means for detecting short-duration transitions in the envelope signal of each filter channel, and means for applying gain to the outputs of these filter channels in which the gain is related to a function of the second-order derivative of the slow-varying envelope signal in each filter channel, to assist in perception of low-intensity short-duration speech features in said signal.

38 Claims, 4 Drawing Sheets

U.S. PATENT DOCUMENTS

| | | | | |
|---|---|---|---|---|
| 4,996,712 | A | 2/1991 | Laurence et al. | |
| 5,165,017 | A | 11/1992 | Eddington et al. | |
| 5,215,085 | A | 6/1993 | von Wallenberg-Pachaly | |
| 5,278,910 | A * | 1/1994 | Suzuki et al. | 704/236 |
| 5,278,912 | A | 1/1994 | Waldhauer | |
| 5,371,803 | A | 12/1994 | Williamson, III | |
| 5,402,498 | A | 3/1995 | Walker, Jr. | |
| 5,408,581 | A * | 4/1995 | Suzuki et al. | 704/226 |
| 5,488,668 | A | 1/1996 | Waldhauer | |
| 5,572,593 | A | 11/1996 | Neilme et al. | |
| 5,583,969 | A * | 12/1996 | Yoshizumi et al. | 704/254 |
| 5,903,655 | A | 5/1999 | Salmi et al. | |
| 5,991,663 | A | 11/1999 | Irlicht et al. | |
| 6,064,913 | A | 5/2000 | Irlicht et al. | |
| 6,078,838 | A | 6/2000 | Rubinstein | |
| 6,104,822 | A | 8/2000 | Melanson et al. | |
| 6,308,155 | B1 * | 10/2001 | Kingsbury et al. | 704/256.1 |
| 6,732,073 | B1 * | 5/2004 | Kluender et al. | 704/233 |

FOREIGN PATENT DOCUMENTS

| | | |
|---|---|---|
| WO | WO 94/25958 A2 | 11/1994 |
| WO | WO 01/31632 A1 | 5/2001 |

OTHER PUBLICATIONS

PCT International Search Report; PCT/AU00/01310; dated Jan. 18, 2001; Applicant: The University of Melbourne; Inventors: Andrew E Vandali et al.

PCT Written Opinion; PCT/AU00/01310; dated Jun. 25, 2001; Applicant: The University of Melbourne; Inventors: Andrew E Vandali et al.

PCT International Preliminary Examination Report; PCT/AU00/01310; dated Oct. 3, 2001; Applicant: The University of Melbourne; Inventors: Andrew E Vandali et al.

* cited by examiner

EMPHASIS OF SHORT-DURATION TRANSIENT SPEECH FEATURES

FIELD OF THE INVENTION

This invention relates to the processing of signals derived from sound stimuli, particularly for the generation of stimuli in auditory prostheses, such as cochlear implants and hearing aids, and in other systems requiring sound processing or encoding.

BACKGROUND OF THE INVENTION

Various speech processing strategies have been developed for processing sound signals for use in stimulating auditory prostheses, such as cochlear prostheses and hearing aids. Such strategies focus on particular aspects of speech, such as formants. Other strategies rely on more general channelization and amplitude related selection, such as the Spectral Maxima Sound Processor (SMSP), strategy which is described in greater detail in Australian Patent No. 657959 by the present applicant, the contents of which are incorporated herein by cross reference.

A recurring difficulty with all such sound processing systems is the provision of adequate information to the user to enable optimal perception of speech in the sound stimulus.

SUMMARY OF THE INVENTION AND OBJECT

It is an object of the present invention to provide a sound processing strategy to assist in perception of low-intensity short-duration speech features in the sound stimuli.

The invention provides a sound processing device having means for estimating the amplitude envelope of a sound signal in a plurality of spaced frequency channels, means for analyzing the estimated amplitude envelopes over time so as to detect short-duration amplitude transitions in said envelopes, means for increasing the relative amplitude of said short-duration amplitude transitions, including means for determining a rate of change profile over a predetermined time period of said short-duration amplitude transitions, and means for determining from said rate of change profile the size of an increase in relative amplitude applied to said transitions in said sound signal to assist in perception of low-intensity short-duration speech features in said signal.

In a preferred form the predetermined time period is about 60 ms. The faster/greater the rate of change, on a logarithmic amplitude scale, of said short-duration amplitude transitions, the greater the increase in relative amplitude which is applied to said transitions. Furthermore rate of change profiles corresponding to short-duration burst transitions receive a greater increase in relative amplitude than do profiles corresponding to onset transitions. In the present specification, a "burst transition" is understood to be a rapid increase followed by a rapid decrease in the amplitude envelope while an "onset transition" is understood to be a rapid increase followed by a relatively constant level in the amplitude envelope.

The above defined Transient Emphasis strategy has been designed in particular to assist perception of low-intensity short-duration speech features for the severe-to-profound hearing impaired or Cochlear implantees. These speech features typically consist of: i) low-intensity short-duration noise bursts/frication energy that accompany plosive consonants; ii) rapid transitions in frequency of speech formants (in particular the 2nd formant, F2) such as those that accompany articulation of plosive, nasal and other consonants. Improved perception of these features has been found to aid perception of some consonants (namely plosives and nasals) as well as overall speech perception when presented in competing background noise.

The Transient Emphasis strategy is preferably applied as a front-end process to other speech processing systems, particularly but not exclusively, for stimulating implanted electrode arrays. The currently preferred embodiment of the invention is incorporated into the Spectral Maxima Sound Processor (SMSP) strategy, as referred to above. The combined strategy known as the Transient Emphasis Spectral Maxima (TESM) Sound Processor utilises the transient emphasis strategy to emphasise the SMSPs filter bank outputs prior to selection of the channels with the largest amplitudes.

As with most multi-channel speech processing systems, the input sound signal is divided up into a multitude of frequency channels by using a bank of band-pass filters. The signal envelope is then derived by rectifying and low-pass filtering the signal in these bands. Emphasis of short-duration transitions in the envelope signal for each channel is then carried out. This is done by: i) detection of short-duration (approximately 5 to 60 milliseconds) amplitude variations in the channel envelope typically corresponding to speech features such as noise bursts, formant transitions, and voice onset; and ii) increasing the signal gain during these periods. The gain applied is related to a function of the $2^{nd}$ order derivative with respect to time of the slow-varying envelope signal (or some similar rule, as described below in the Description of Preferred Embodiment).

During periods of steady state or relatively slow varying levels in the envelope signal (over a period of approximately 60 ms) no gain is applied. During periods where short-duration transition in the envelope signal are detected, the amount of gain applied can typically vary up to about 14 dB. The gain varies depending of the nature of the short-duration transition which can be classified as either of the following. i) A rapid increase followed by a decrease in the signal envelope (over a period of no longer than approximately 60 ms). This typically corresponding to speech features such as the noise-burst in plosive consonant or the rapid frequency shift of a formant in a consonant-to-vowel or vowel-to-consonant transition. ii) A rapid increase followed by relatively constant level in the signal envelope which typically corresponds to speech features such as the onset of voicing in a vowel. Short duration speech features classified according to i) are considered to be more important to perception than those classified according to ii) and thus receive relatively twice as much gain. Note, a relatively constant level followed by a rapid decrease in the signal envelope which corresponds to abruption of voicing/sound receive little to no gain.

BRIEF DESCRIPTION OF TILE DRAWINGS

In order that the invention may be more readily understood, one presently preferred embodiment of the invention will now be described with reference to the accompanying drawings in which.

DESCRIPTION OF PREFERRED EMBODIMENT

Figure 1:
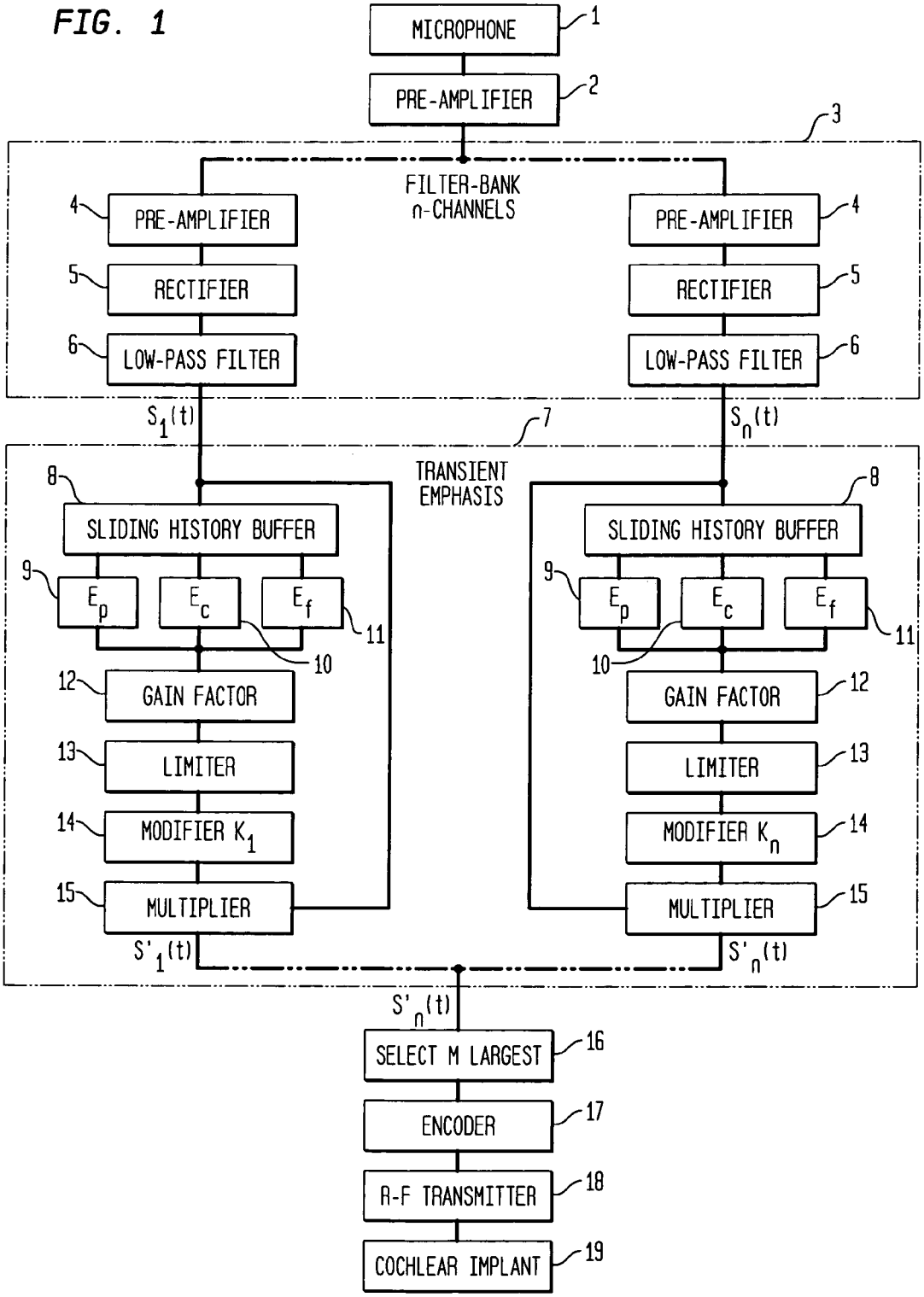
FIG. 1 is a schematic representation of the signal processing applied to the sound signal in accordance with the present invention.

Referring to FIG. 1, the presently preferred embodiment of the invention is described with reference to its use with the SMSP strategy. As with the SMSP strategy, electrical signals corresponding to sound signals received via a microphone 1 and pre-amplifier 2 are processed by a bank of N parallel filters 3 tuned to adjacent frequencies (typically N=16). Each filter channel includes a band-pass filter 4, then a rectifier 5 and low-pass filter 6 to provide an estimate of the signal amplitude (envelope) in each channel. In this embodiment a Fast Fourier Transform (FFT) implementation of the filter bank is employed. The outputs of the N-channel filter bank are modified by the transient emphasis algorithm 7 (as described below) prior to further processing in accordance with the SMSP strategy.

A running history, which spans a period of 60 ms. at 2.5 ms intervals, of the envelope signals in each channel, is maintained in a sliding buffer 8 denoted $S_n(t)$ where the subscript n refers to the channel number and t refers to time relative to the current analysis interval. This buffer is divided up into three consecutive 20 ms time windows and an estimate of the slow-varying envelope signal in each window is obtained by averaging across the terms in the window. The averaging window provides approximate equivalence to a $2^{nd}$-order low-pass filter with a cut-off frequency of 45 Hz and is primarily used to smooth fine envelope structure, such as voicing frequency modulation, and unvoiced noise modulation. Averages from the three windows are therefore estimates of the past ($E_p$) 9, current ($E_c$) 10 and future ($E_f$) 11 slow-varying envelope signal with reference to the mid-point of the buffer $S_n(t)$. The amount of additional gain applied is derived from a function of the slow-varying envelope estimates as per Eq. (1). A derivation and analysis of this function can be found in Appendix A.

$$G=(2\times E_c-2\times E_p-E_f)/(E_c+E_p+E_f) \quad (1)$$

The gain factor (G) 12 for each channel varies with the behaviour of the slow-varying envelope signals such that: (a) short-duration signals which consisted of a rapid rise-followed by a rapid fall (over a time period of no longer than approximately 60 ms) in the slow-varying envelope signal produces the greatest values of G. For these types of signals, G could be expected to range from approximately 0 to 2. (b), The onset of long-duration signals which consist of a rapid rise followed by a relatively constant level in the envelope signal produces lower levels of G which typically range from 0 to 0.5. (c) A relatively steady-state or slow varying envelope signal produces negative value of G. (d) A relatively steady-state level followed by a rapid decrease in the envelope signal (i.e. cessation/offset of envelope energy) produces small (less than approximately 0.1) or negative values of G. Because negative values of G could arise, the result of Eq. (1) are limited at 13 such that it can never fall below zero as per Eq. (2)

$$\text{If } (G<0) \text{ then } G=0 \quad (2)$$

Another important property of Eq. (1) is that the gain factor is related to a function of relative differences, rather than absolute levels, in the magnitude of the slow-varying envelope signal. For instance, short-duration peaks in the slow-varying envelope signal of different peak levels but identical peak to valley ratios would be amplified by the same amount.

The gain factors for each channel ($G_n$), where n denotes the channel number, are used to scale the original envelope signals $S_n(t)$ according to Eq. (3), where $t_m$ refers to the midpoint of the buffer $S_n(t)$.

$$S'_n(t_m)=S_n(t_m)\times(1+K_n\times G_n) \quad (3)$$

A gain modifier constant ($K_n$) is included at 14 for adjustment of the overall gain of the algorithm. In this embodiment, $K_n=2$ for all n. During periods of little change in the envelope signal of any channel, the gain factor ($G_n$) is equal to zero and thus $S'_n(t_m)=(t_m)$, whereas, during periods of rapid-change, $G_n$ could range from 0 to 2 and thus a total of 0 to 14 dB of gain could be applied. Note that because the gain is applied at the midpoint of the envelope signals, an overall delay of approximately 30 ms between the time from input to output of the transient emphasis algorithm is introduced. The modified envelope signals $S'_n(t)$ at 15 replaces the original envelope signals $S_n(t)$ derived from the filter bank and processing then continues as per the SMSP strategy. As with the SMSP strategy, M of the N channels of $S'_n(t)$ having the largest amplitude at a given instance in time are selected at 16 (typically M=6). This occurs at regular time intervals and for the transient emphasis strategy is typically 2.5 ms. The M selected channels are then used to generate M electrical stimuli 17 of stimulus intensity and electrode number corresponding to the amplitude and frequency of the M selected channels (as per the SMSP strategy). These M stimuli are transmitted to the Cochlear implant 19 via a radio-frequency link 18 and are used to activate M corresponding electrode sites.

Because the transient emphasis algorithm is applied prior to selection of spectral maxima, channels containing low-intensity short-duration signals, which: (a) normally fall below the mapped threshold level of the speech processing system; (b) or are not selected by the SMSP strategy due to the presence of channels containing higher amplitude steady-state signals: are given a greater chance of selection due to their amplification.

Figure 2:
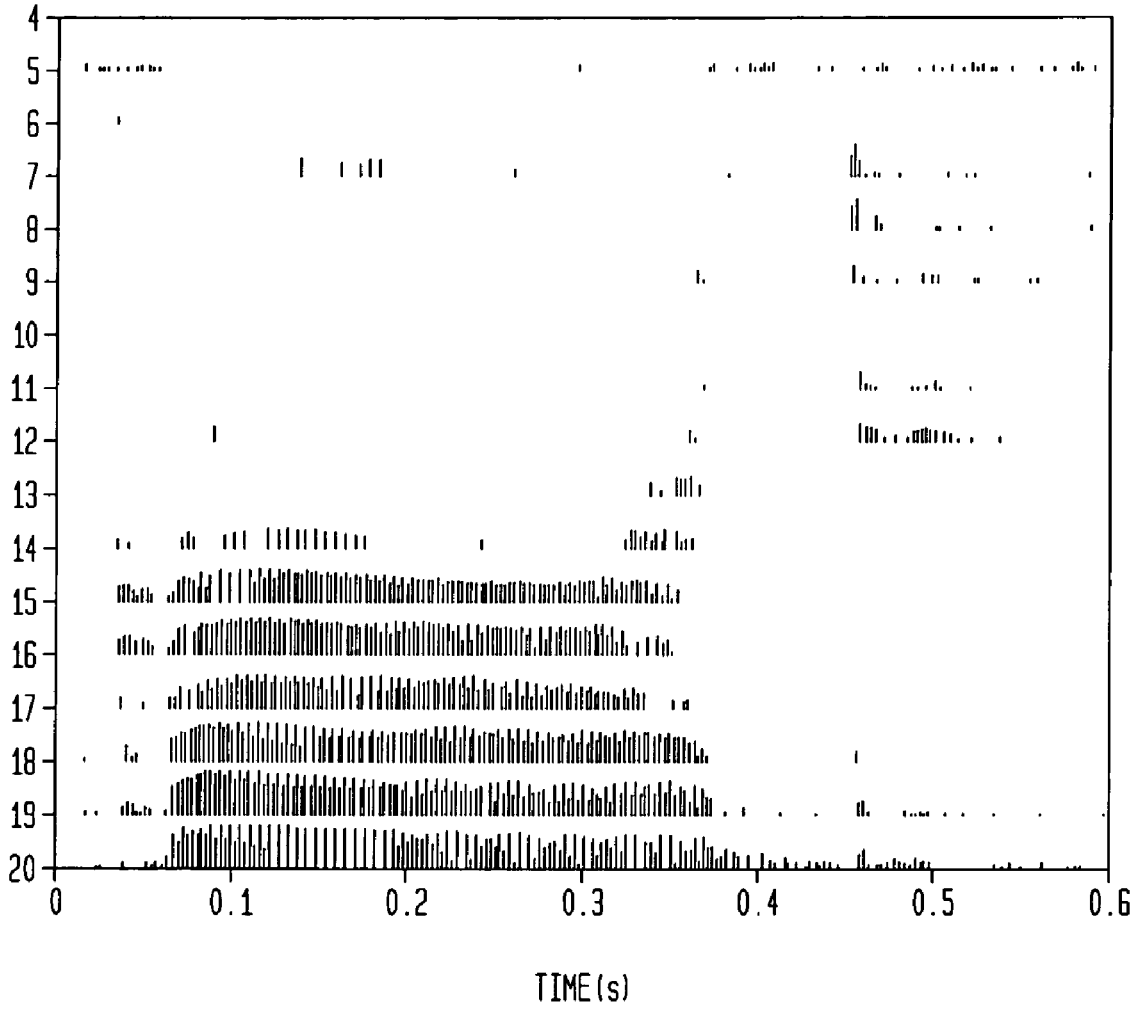
FIGS. 2 and 3 are comparative electrodograms of sound signals to show the effect of the invention.
Figure 3:
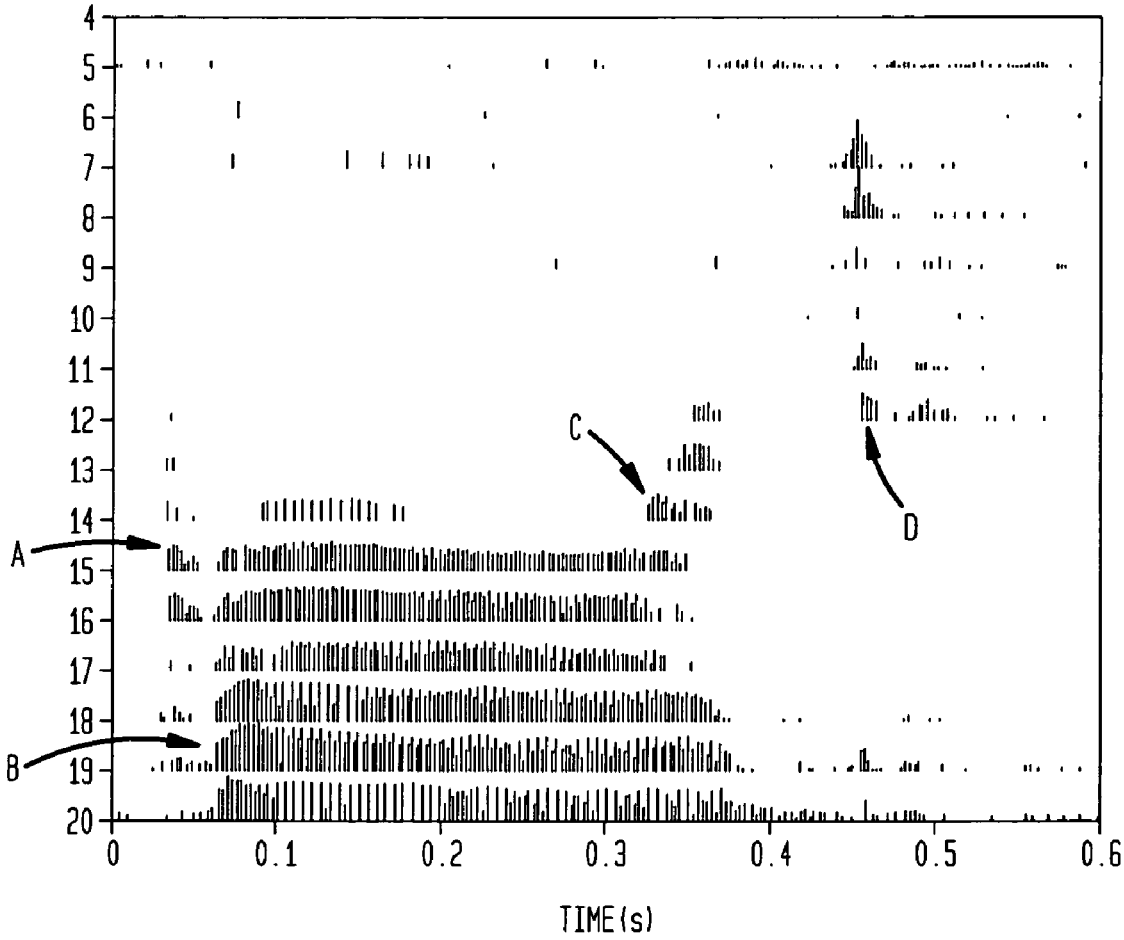

To illustrate the effect of the strategy on the coding of speech signals, stimulus output patterns, known as electrodograms (which are similar to spectrograms for acoustic signals), which plot stimulus intensity per channel as a function of time, were recorded for the SMSP and TESM strategies, and are shown in FIGS. 2 & 3 respectively. The speech token presented in these recordings was /g o d/ and was spoken by a female speaker. The effect of the TESM strategy can be seen in the stimulus intensity and number of electrodes representing the noise burst energy in the initial stop /g/ (point A). The onset of the formant energy in the vowel /o/ has also been emphasised slightly (point B). Most importantly, stimuli representing the second formant transition from the vowel /o/ to the final stop /d/ are also higher in intensity (point C), as are those coding the noise burst energy in the final stop /d/ (point D).

APPENDIX A: TESM GAIN FACTOR

To derive a function for the gain factor (G) 12 for each channel in terms of the slow-varying envelope signal the following criteria were used. Firstly, the gain factor should be related to a function of the $2^{nd}$ order derivative of the slow-varying envelope signal. The $2^{nd}$ order derivative is maximally negative for peaks (and maximally positive for valleys) in the slow-varying envelope signal and thus it should be negated; Eq. (A1).

$$G\propto 2\times E_c-E_p-E_f \quad (A1)$$

Secondly, for the case when the 'backward' gradient (i.e. $E_c-E_p$) is positive but small, significant gain as per Eq. (A1) can result when $E_f$ is small (i.e. at the cessation (offset) of envelope energy for a long-duration signal). This effect is not desirable and can be minimised by reducing the backward gradient to near zero or less (i.e. negative) in cases when it is small. However, when the backward gradient is large, Eq. (A1) should hold. A simple solution is to scale $E_p$ by 2. A function for the 'modified' $2^{nd}$ order derivative is given in Eq. (A2). As $E_p$ approaches $E_c$, G approaches $-E_f$ rather than $E_c-E_f$, as in Eq. (A1) and thus the gain factor approaches a small or negative value. However for $E_p<<E_c$, G approaches $2\times E_c-E_f$, which is identical to the limiting condition for Eq. (A1).

$$G\propto 2\times E_c-2\times E_p-E_f \tag{A2}$$

Thirdly, because we are interested in providing gain based on relative rather than absolute differences in the slow-varying envelope signal, the gain factor should be normalised with respect to the average level of slow-varying envelope signal as per Eq. (A3). The effect of the numerator in Eq. (A3) compresses the linear gain factor as defined in Eq. (A2) into a range of 0 to 2. The gain factor is now proportional to the modified $2^{nd}$ order derivative and inversely proportional to the average level of the slow-varying envelope channel signal.

$$G(2\times E_c-2\times E_p-E_f)/(E_c+E_p+E_f) \tag{A3}$$

Finally, the gain factor according to Eq. (A3) can fall below zero when $E_c<E_p+E_f/2$. Thus, Eq. (A4) is imposed on $G_n$ so that the gain is always greater than or equal to zero.

$$\text{If } (G<0) \text{ then } G=0 \tag{A4}$$

An analysis of the limiting cases for the gain factor can be used to describe its behaviour as a function of the slow-varying envelope signal. For the limiting case when $E_p$ is much smaller than $E_c$ (i.e. during a period of rapid-rise in the envelope signal), Eq. (A3) reduces to:

$$G=(2\times E_c-E_f)/(E_c+E_f) \tag{A5}$$

In this case, if $E_f$ is greater than $E_c$ and approaches $2\times E_c$, (i.e. during a period of steady rise in the slow-varying envelope signal), G approaches zero. If $E_f$ is similar to $E_c$(i.e. at the end a period of rise for a long-duration signal), G is approximately 0.5. If $E_f$ is a lot smaller than $E_c$ (i.e. at the apex of a rapid-rise which is immediately followed by a rapid fall as is the case for short-duration peak in the envelope signal) G approaches 2, which is the maximum value possible for G.

For the limiting case when $E_f$ is much smaller than $E_c$, Eq. (A3) reduces to:

$$G=(2\times E_c-2\times E_p)/(E_c+E_p) \tag{A6}$$

In this case, if $E_c$ is similar to $E_p$ (i.e. cessation/offset of envelope for a long-duration signal), G approaches zero. If $E_c$ is much greater than $E_p$ (i.e. at a peak in the envelope), G approaches the maximum gain of 2.

When dealing with speech signals, intensity is typically defined to on a log (dB) scale. It is thus convenient to view the applied gain factor in relation to the gradient of the log-magnitude of the slow-varying envelope signal. Eq. (A3) can be expressed in terms of ratios of the slow-varying envelope signal estimates. Defining the backward magnitude ratio as $R_b=E_c/E_p$ and the forward magnitude ratio $R_{f=Ef}/E_c$ gives Eq. (A7).

$$G=(2\times R_b-2-R_b\times R_f)/(R_b+1+R_b\times R_f) \tag{A7}$$

Figure 4:
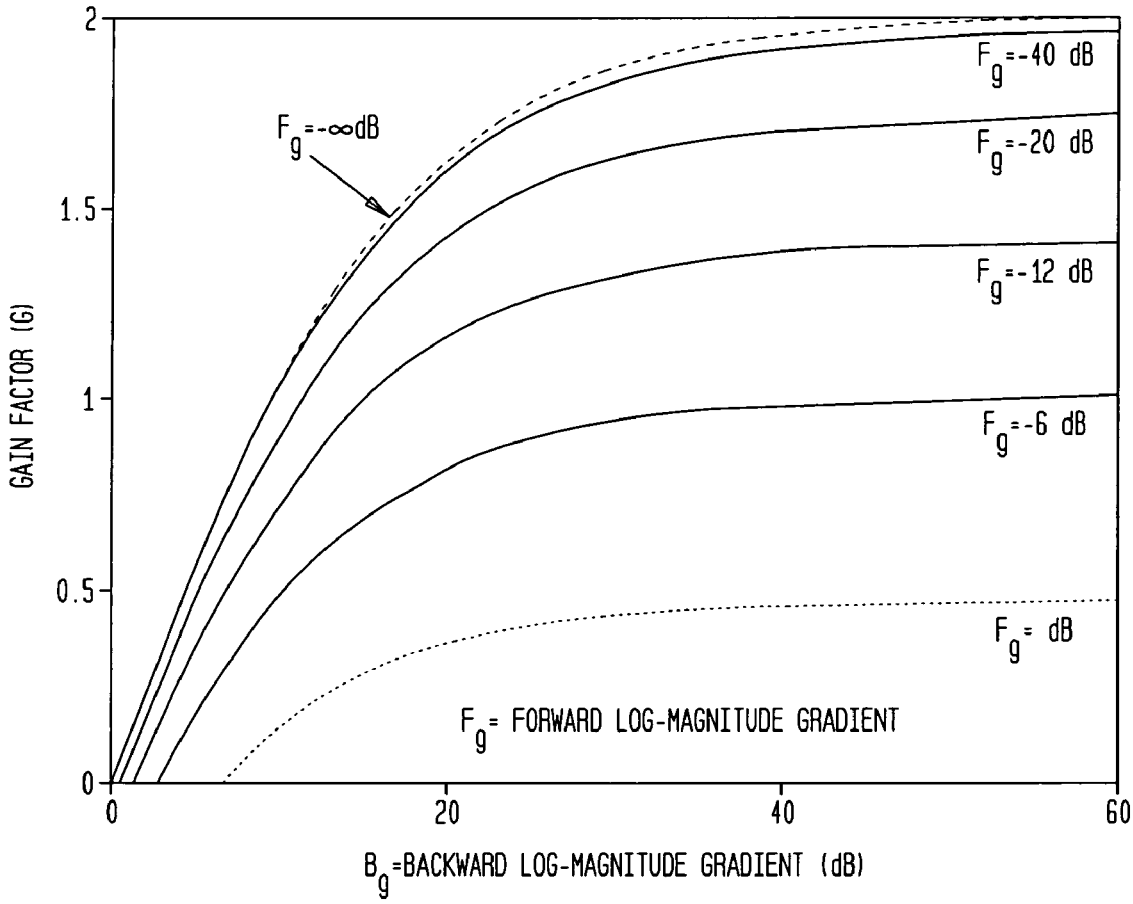
FIG. 4 is a graph illustrating the relationship between gain factor and forward and backward log-magnitude gradients.

The forward and backward magnitude ratios are equivalent to log-magnitude gradients and can be as defined as the difference between log-magnitude terms, i.e. $F_g=\log(E_f)-\log(E_c)$ and $B_g=\log(E_c)-\log(E_p)$ respectively. The relationship between gain factor and forward and backward log-magnitude gradients is shown in FIG. 4. In FIG. 4, linear gain is plotted on the ordinate and backward log-magnitude gradient (in dB) is plotted on the abscissa. The gain factor is plotted for different levels of the forward log-magnitude gradient in each of the curves. For any value of the forward log-magnitude gradient, the gain factor reaches some maximum when the backward log-magnitude gradient is approximately 40 dB. The maximum level is dependent on the level of the forward log-magnitude gradient. For the case where the forward log-magnitude gradient is 0 dB, as shown by the dotted line (i.e. at the end a period of rise for a long-duration signal where $E_f=E_c$), the maximum gain possible is 0.5. For the limiting case where the forward log-magnitude gradient is infinitely steep as shown by the dashed line (i.e. rapid-fall in envelope signal where $E_f<<E_c$), the maximum gain possible is 2.0. The limiting case for the forward log-magnitude gradient is reached when its gradient is approximately −40 dB.

What is claimed is:

1. A sound processing device comprising:

a filter-bank configured to divide a sound input into a multitude of spaced frequency channels, and to derive an amplitude envelope for each of said multitude of frequency channels;

a transient emphasis algorithm subsystem configured to detect a short-duration amplitude transition for each of said amplitude envelopes, and further configured to emphasize said short-duration amplitude transitions for each of said amplitude envelopes based on relative differences in amplitude of said each amplitude envelope.

2. The device of claim 1, wherein said filter bank further comprises:

a plurality of band pass filters configured to divide said sound input into said multitude of frequency channels.

3. The device of claim 1, wherein said filter bank further comprises;

a plurality of rectifiers and low pass filters configured to derive said amplitude envelope for each of said frequency channels.

4. The device of claim 1, wherein said transient emphasis algorithm subsystem emphasizes said short-duration amplitude transitions by applying a gain factor to said short-duration amplitude transitions.

5. The device of claim 4, wherein said transient emphasis algorithm subsystem further comprises:

a sliding buffer for each frequency channel configured to maintain a running history of said amplitude envelope in said channel; and wherein said transient emphasis algorithm subsystem determines said gain factor for each said short-duration amplitude transition in each said frequency channel based on said history maintained in each said buffer.

6. The device of claim 5, wherein said buffer maintains a running history of approximately 60 ms.

7. The device of claim 4, wherein said gain factor is related to a function of a $2^{nd}$-order derivative of the amplitude envelope for each said frequency channel.

8. The device of claim 4, wherein said gain factor applied to one of said short-duration amplitude transitions ranges from about 0 to about 2 for an amplitude envelope having a short-duration amplitude transition comprising a rapid rise followed by a rapid fall.

9. The device of claim 8, wherein said gain factor from about 0 to about 2 causes a gain increase in the range of about 0 up to about 14 dB.

10. The device of claim 4, wherein said gain factor applied to one of said short-duration amplitude transitions ranges from about 0 to about 0.5 for an amplitude envelope having a short-duration amplitude transition comprising a rapid rise followed by a relatively constant level.

11. The device of claim 10, wherein said gain factor from about 0 to about 0.5 causes a gain increase in the range of about 0 up to about 6 dB.

12. The device of claim 10, wherein said gain factor approximately less than 0.1 causes little or no increase in gain.

13. The device of claim 4, wherein said gain factor applied to one of said short-duration amplitude transitions is approximately less than 0.1 for an amplitude envelope having a short-duration amplitude transition comprising a steady state level followed by a rapid decrease.

14. The device of claim 4, wherein said gain factor applied to one of said short-duration amplitude transitions is about 0 for an amplitude envelope having a short-duration amplitude transition comprising a steady state level or a slowly varying profile.

15. The device of claim 1, wherein said amplitude envelopes exhibiting short-duration amplitude transitions having different peak levels but similar peak to valley ratios are emphasized by approximately similar amounts.

16. A cochlear implant comprising:

a microphone configured to receiving an input sound signal;

a preamplifier configured to amplify said input sound signal;

a sound processing system comprising:

a filter-bank configured to divide a sound input into a multitude of spaced frequency channels, said filter-bank further configured to derive an amplitude envelope for each of said multitude of frequency channels;

a transient emphasis algorithm subsystem configured to detect a short-duration amplitude transition for each of said amplitude envelopes;

said transient emphasis algorithm subsystem further configured to emphasize said short-duration amplitude transitions for each of said amplitude envelopes based on relative differences in amplitude of each said amplitude envelope; and an implanted electrode array configured to stimulate a cochlea of an implantee based on one or more of said emphasized short-duration amplitude transisitions.

17. The implant of claim 16, wherein said filter bank further comprises:

a plurality of band pass filters configured to divide said sound input into said multitude of frequency channels.

18. The implant of claim 16, wherein said filter bank further comprises;

a plurality of rectifiers and low pass filters configured to derive said amplitude envelope for each of said frequency channels.

19. The implant of claim 16, wherein said transient emphasis algorithm subsystem emphasizes said short-duration amplitude transitions by applying a gain factor to said short-duration amplitude transitions.

20. The implant of claim 19, wherein said transient emphasis algorithm subsystem further comprises:

a sliding buffer for each frequency channel configured to maintain a running history of said amplitude envelope in said channel; and wherein said transient emphasis algorithm subsystem determines said gain factor for each said short-duration amplitude transition in each said frequency channel based on said history maintained in each said buffer.

21. The implant of claim 20, wherein said buffer maintains a running history of approximately 60 ms.

22. The implant of claim 19, wherein said gain factor is related to a function of a $2^{nd}$-order derivative of the amplitude envelope in each said frequency channel.

23. The implant of claim 19, wherein said gain factor applied to one of said short-duration amplitude transitions ranges from about 0 to about 2 for an amplitude envelope having a short-duration amplitude transition comprising a rapid rise followed by a rapid fall.

24. The implant of claim 23, wherein said gain factor from about 0 to about 2 causes a gain increase in the range of about 0 up to about 29 dB.

25. The implant of claim 19, wherein said gain factor applied to one of said short-duration amplitude transitions ranges from about 0 to about 0.5 for an amplitude envelope having a short-duration amplitude transition comprising a rapid rise followed by a relatively constant level.

26. The implant of claim 25, wherein said gain factor from about 0 to about 0.5 causes a gain increase in the range of about 0 up to about 6 dB.

27. The implant of claim 25, wherein said gain factor approximately less than 0.1 causes little or no increase in gain.

28. The implant of claim 19, wherein said gain factor applied to one of said short-duration amplitude transitions is approximately less than 0.1 for an amplitude envelope having a short-duration amplitude transition comprising a steady state level followed by a rapid decrease.

29. The implant of claim 19, wherein said gain factor applied to one of said short-duration amplitude transitions is about 0 for an amplitude envelope having a short-duration amplitude transition comprising a steady state level or a slowly varying profile.

30. The implant of claim 16, wherein said amplitude envelopes exhibiting short-duration amplitude transitions having different peak levels but similar peak to valley ratios are emphasized by approximately similar amounts.

31. A sound processing device comprising:

means for dividing said sound into a multitude of spaced frequency channels;

means for deriving an amplitude envelope for each of said multitude of frequency channels;

means for detecting a short-duration amplitude transition for each of said amplitude envelopes;

means for emphasizing said short-duration amplitude transitions for each of said amplitude envelopes based on relative differences in amplitude of each said amplitude envelope.

32. The device of claim 31, wherein said means for dividing said sound into a multitude of frequency channels further comprises:

means for band pass filtering said sound.

33. The device of claim 31, wherein means for deriving an amplitude envelope for each of said multitude of frequency channels further comprises:

means for rectifying a sound in said frequency channels; and means for low pass filtering said sound in said frequency channels.

34. The device of claim 31, wherein means for emphasizing said short-duration amplitude transitions further comprises:

means for applying a gain factor to said short-duration amplitude transitions.

35. A method of processing a sound comprising the steps of:

dividing said sound into a multitude of spaced frequency channels;

deriving an amplitude envelope for each of said multitude of frequency channels;

detecting a short-duration amplitude transition for each of said amplitude envelopes;

emphasizing said short-duration amplitude transitions for each of said amplitude envelopes based on relative differences in amplitude of said amplitude envelopes.

36. The method of claim 35, wherein dividing said sound into a multitude of frequency channels further comprises:

dividing said sound with a plurality of band pass filters.

37. The method of claim 35, wherein deriving an amplitude envelope for each of said multitude of frequency channels further comprises:

rectifying a sound in said frequency channels; and low pass filtering said sound in said frequency channels with at least one low pass filter.

38. The method of claim 35, wherein emphasizing said short-duration amplitude transitions further comprises:

applying a gain factor to said short-duration amplitude transitions.

* * * * *